United States Patent [19]

Irwin

[11] Patent Number: 5,037,303

[45] Date of Patent: Aug. 6, 1991

[54] SKI TRAINING MIRROR METHOD AND APPARATUS

[76] Inventor: Jack L. Irwin, 8298 Reid Rd., Swartz Creek, Mich. 48473

[21] Appl. No.: 410,830

[22] Filed: Sep. 22, 1989

[51] Int. Cl.[5] ..... A63B 69/18

[52] U.S. Cl. ..... 434/253; 434/247; 280/809; 273/35 A

[58] Field of Search ..... 273/35 A, 35 B; 434/253, 247; 280/809, 87.042; 350/631, 632; 248/466, 467

[56] References Cited

U.S. PATENT DOCUMENTS

| | | | |
|---|---|---|---|
| 3,915,457 | 10/1975 | Casey | 273/35 A X |
| 3,917,278 | 11/1975 | Steinman, Jr. | 273/35 A X |
| 4,311,363 | 1/1982 | Marsalka et al. | 248/467 X |
| 4,482,210 | 11/1984 | Brookman | 350/631 |
| 4,764,004 | 8/1988 | Yamada et al. | 350/632 |
| 4,834,521 | 5/1989 | Dubs | 248/467 X |
| 4,836,490 | 6/1989 | Mittelhauser et al. | 350/632 X |
| 4,925,287 | 5/1990 | Lord et al. | 248/467 X |

FOREIGN PATENT DOCUMENTS

| | | | |
|---|---|---|---|
| 2537877 | 6/1984 | France | 273/35 A |
| 2130103 | 5/1984 | United Kingdom | 273/35 A |

OTHER PUBLICATIONS

*Skate Boarder*, "More Incredible High-Speed Action Sequences", vol. 4, No. 3, Oct. 1977, class 280, subclass 87.042.

*Primary Examiner*—Richard J. Apley
*Assistant Examiner*—J. L. Doyle
*Attorney, Agent, or Firm*—Weintraub, DuRoss & Brady

[57] ABSTRACT

A mirrored training device for attachment to a ridden board-type athletic device is disclosed. The training device comprises a convex mirror in a shockproof case having attachment means for securing the training device to the board surface. The mirror casing may be angled, or unequal length legs may be provided, so that the attached convex mirror is inclined towards the rider's normal board riding position to provide a full reflection thereof. Dividing lines are provided on the mirror surface as reference points for the posture of the athlete. In an alternative embodiment the mirrored device is built into the ridden-board-type device.

21 Claims, 2 Drawing Sheets

FIG 1
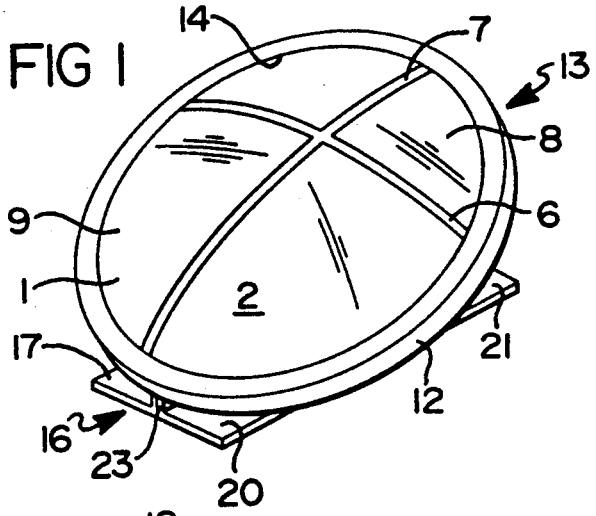
FIG 2
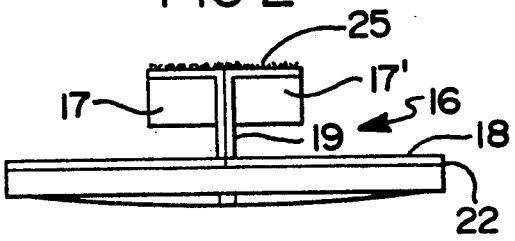
FIG 3
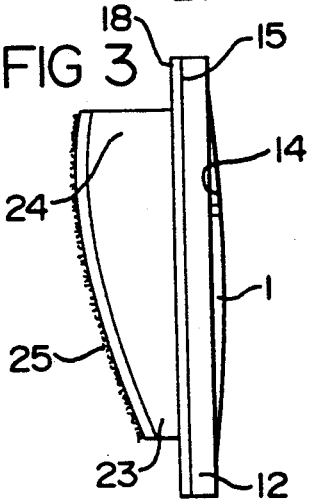
FIG 4
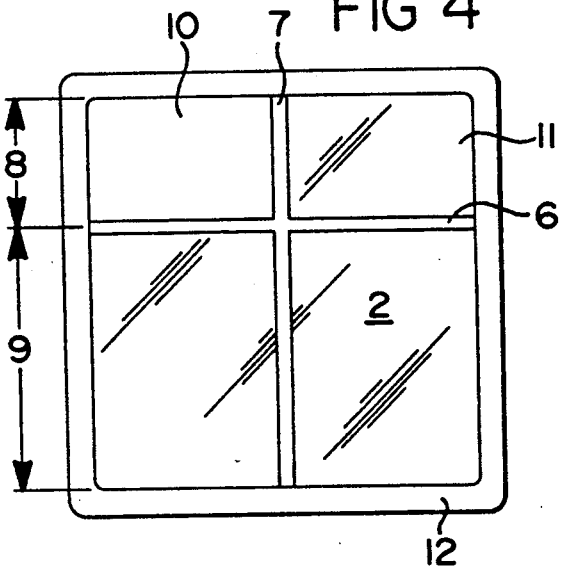
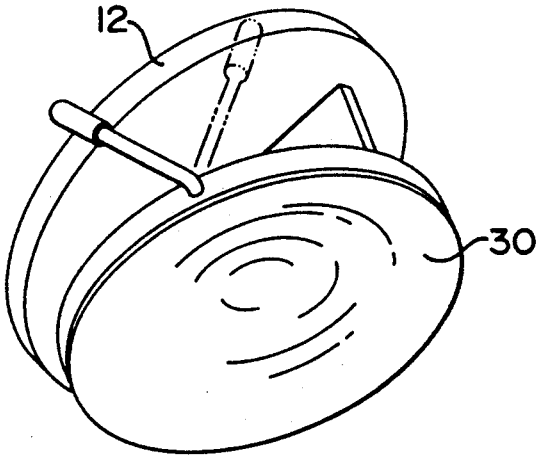
FIG 5
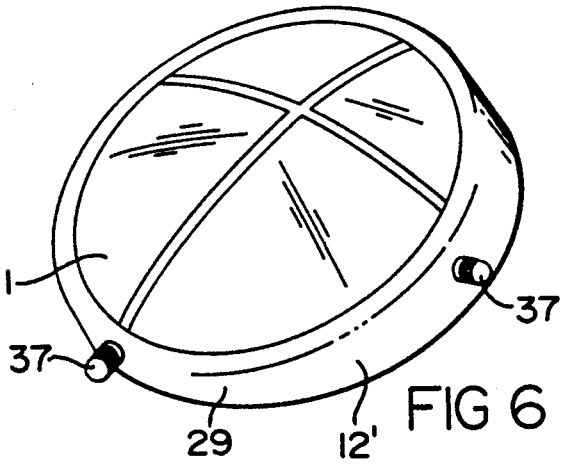
FIG 6
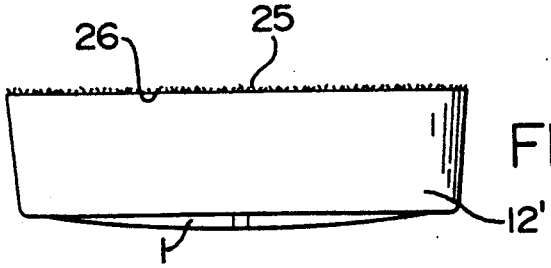
FIG 7

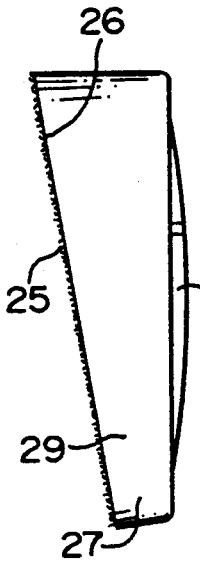
FIG 8
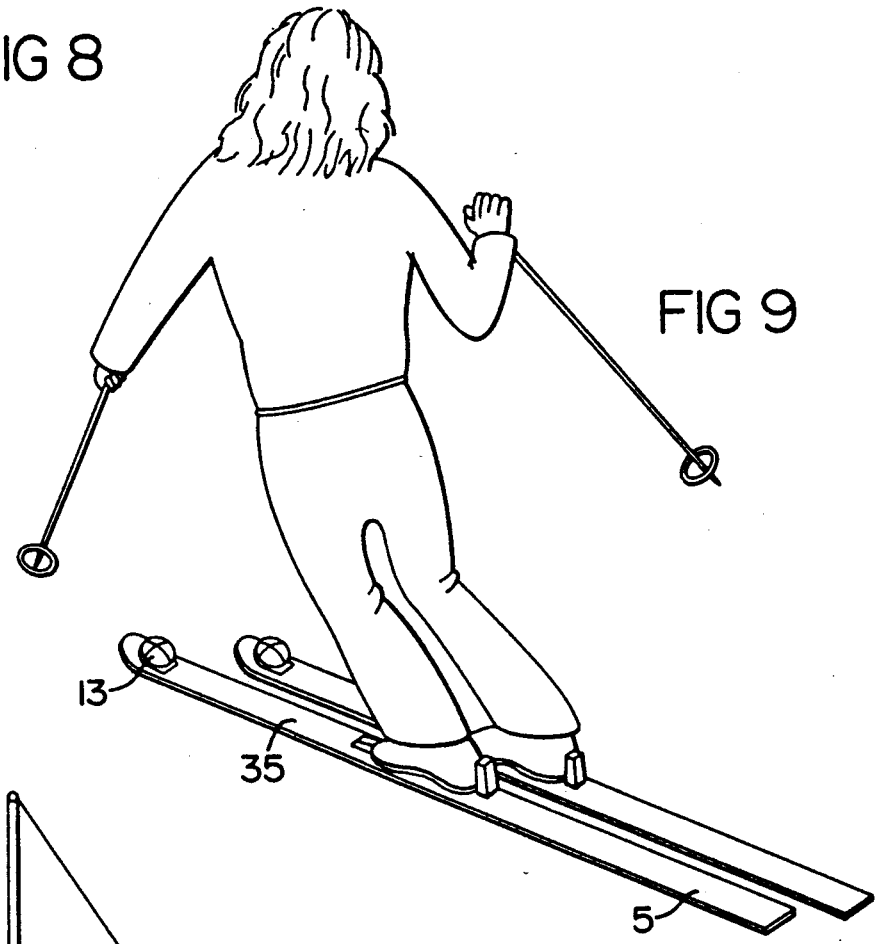
FIG 9
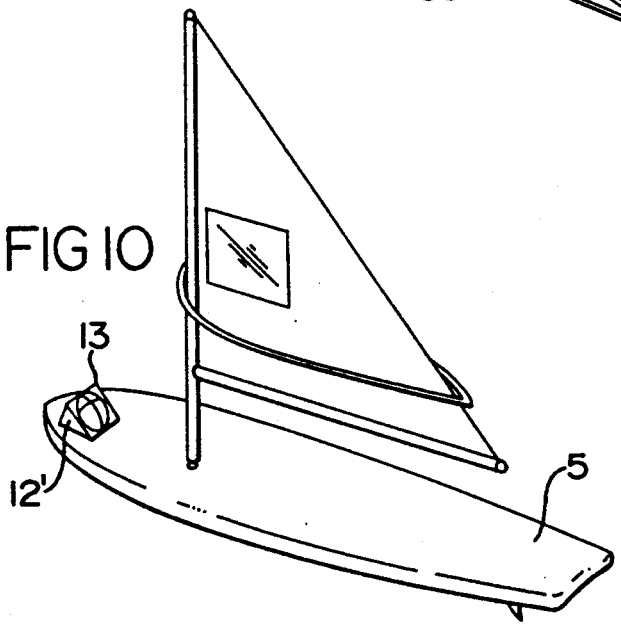
FIG 10
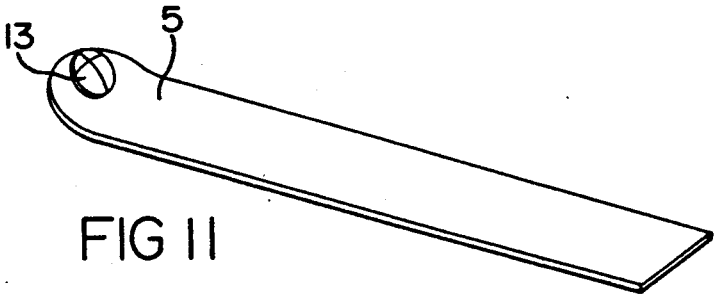
FIG 11
FIG 12
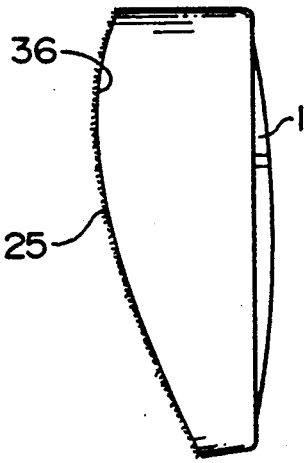

SKI TRAINING MIRROR METHOD AND APPARATUS

BACKGROUND OF THE INVENTION

1. Field of the Invention

The present invention relates generally to sports training devices. More specifically it relates to training devices of the type used in sports where the participant rides a board-type device such as skis, a sail-board, snow-board etc.

2. Description of the Prior Art

In board riding athletic activities such as water or snow skiing, sailboarding, snowboarding etc. the posture of the rider is very important to safe participation and proper enjoyment of the sport. Particularly, the relation between the upper and lower torso and appendages may mean the difference between numerous falls from the board equipment and a safe and enjoyable recreational experience. Proper balance between the left and right sides of the body can also be extremely important in this regard.

However, when in motion the rider may lack a proper frame of reference in which to check and correct for proper riding posture. This may be especially true if a qualified instructor is not in the immediate area of participation.

Heretofore, devices have been proposed which allow an athlete to check his posture during practice of his sport. Such devices as are know to applicant include:

U.S. Pat. No. 3,110,495 which discloses a system of mirror angled in relation to each other so as to allow a golfer to view his swing while retaining a proper golfing stance. The mirrors may be variously marked so as to provide reference marks or the golfer. A convex mirror is utilized in one embodiment.

U.S. Pat. No. 3,915,457 discloses a golf instruction device utilizing transparent instruction overlays on an inclinedly mounted convex mirror designed to be placed at ground level.

U.S. Pat. No. 4,181,307 discloses a box-like platform on which a golfer stands and tees up the ball. Between the golfer and the tee is a recessed mirror angled towards the golfer. The mirror is preferably provided with parallel reference lines parallel to the golf swing and transverse reference lines for the feet of the golfer.

In U.S. Pat. No. 4,383,687 there is disclosed another golf training device resting on a carpet, having a convex mirror with adjustable inclination. A reference line bisects the mirror into left and right halves.

These devices are designed for activities where the participant is stationary and a firm resting place is provided for the mirrored surfaces. None are suitable for attachment to a riding-board-type athletic device and specifically adapted to provide instructional feedback for the posture necessary for board-riding activities.

The present invention solves these problems by providing a durable, board-riding training mirror device which provides the participant with feedback in the form of his reflection in relation to various specially placed reference lines while in motion on the board device. The device may be releasably, or permanently, attached to the ridden board.

SUMMARY OF THE INVENTION

The present invention provides a training device for board-riding sports comprising:

(a) a convex mirror with reference markings thereon, and, (b) attachment means for removably affixing the training device to the ridden board.

The present invention is particularly adaptable to boards such as skis which are normally ridden in pairs. Such boards will be understood to be included within the singular term "board" as used herein. A casing may be provided with an angled base to incline the mirror towards the rider. The attachment means are then affixed to the base. The device is then attached to the ridden board. The inclination of the mirror provides a substantially full body reflection of the rider.

Reference lines are provided on the convex mirror surface to allow the rider to easily determine if his posture is correct for the given activity by comparing his reflection with the reference lines. The mirror surface is of a size suitable to allow the rider to check his reflection with a quick glance.

Alternatively, the training device may be permanently or semi-permanently affixed to the ridden board as an integral component thereof if removal is deemed unnecessary.

BRIEF DESCRIPTION OF THE DRAWINGS

FIG. 1 is a perspective view of one embodiment of the ski training mirror.

FIG. 2 is an elevation view of the ski training mirror of FIG. 1.

FIG. 3 is a side view of the embodiment of FIG. 1.

FIG. 4 is a top plan view of FIG. 1.

FIG. 5 is a bottom perspective of the ski training mirror illustrating alternative attachment means.

FIG. 6 is a perspective view of a second embodiment of the ski training mirror.

FIG. 7 is an elevational view of the second embodiment.

FIG. 8 is a side view of the second embodiment.

FIG. 9 is an environmental view of the ski training mirror.

FIG. 10 illustrates an embodiment of the invention including attachment to a ridden board.

FIG. 11 illustrates an embodiment wherein the ski training mirror is placed integrally with the surface of the board.

DESCRIPTION OF THE PREFERRED EMBODIMENTS

The first embodiment of the mirrored training device 13 comprises a convex mirror 1 with reference lines 6, 7 thereon, a casing 12 surrounding the mirror, and releasable mounting means 25 for affixing the training device 13 to a ridden-board type athletic device 5.

As seen in FIG. 1, the convex mirror 1 provides a reflective surface 2 which provides a wide angle reflected image 3 of the rider 4. The opposite or undersurface of the mirror 14 is a non-reflective surface 14. The mirror is formed of impact resistance, shatterproof material such as plastic or metal for safety reasons. Although illustrated as round, the convex mirror made be provided in other suitable shapes, most notably rectangular as seen in FIG. 4, and dimensioned to provide a substantially full-body reflection of the rider in normal position on the board 5.

Visible on the reflective surface 2 of the convex mirror 1 are the horizontal reference line 6 and the vertical reference line 7. The horizontal reference line 6 divides the reflective surface 2 into approximately a one-thirds area 8 to two thirds area 9 ratio. The one-third area 8, or far area from the rider's viewpoint, reflects the upper torso and appendages of the rider 4. The horizontal line 6 will pass through the shoulder region image of the rider 4 substantially at arm pit level when the device is correctly mounted. The two-thirds area 9, or near area from the rider's viewpoint, reflects the lower torso and appendages of the rider 4. It will be noted that the feet of the rider may not be reflected but this absent reflection will not effect the utility of the device. The vertical reference line 7 bisects the reflective surface 2 into a left half 10 and a right half 11. Thus the reference lines will help the rider 4 determine at a glance if his posture is appropriate while riding the board 5. Appropriate instructional material may be provided with the device as an aid to the proper utilization thereof.

The reference lines 6, 7 may be etched and dyed on the reflective surface 2, etched on the non-reflective mirror surface, painted, appliqued, or otherwise suitably applied. Other suitable reference line configurations may be used as dictated by the demands of the particular riding activity. Alternatively, any or all of the reference lines may be omitted if considered unnecessary to a particular activity, such as sailboarding which may require constant movement by the rider upon his board.

A casing 12 encloses the mirror 1 on all but the reflective surface 2. The casing 12 retains and protects the mirror 1 and also serves as an attachment point for other parts of the training device 13. In the embodiment of FIGS. 1–4 the casing 12 overlies the edges of the reflective surface 2 and covers all other surfaces of the convex mirror 1. The underside casing surface 15 covering the non-reflective mirror surface 14 is generally flat. To this underside casing surface 15 is fixedly attached a mounting assembly 16 comprising two fixedly joined mirror-image leg assemblies 17, 17'. Alternatively the mounting assembly may be a single unit. Each leg assembly 17 provides a mounting base 18, a leg portion 19, and a first foot 20 and a second foot 21.

The mounting base 18 is fixedly secured as by an adhesive layer 22, to the underside casing surface 15. Alternatively, the mounting base 18 may be formed integrally with the casing 12. Extending generally perpendicularly from the mounting base 18 is the leg portion 19. Under the two-third mirror area 9 is a first leg portion 23. Under the mirror far, or one-third, area 8 is a second leg portion 24. The first leg portion 23 is made shorter than the second leg portion 24 to provide an inclination of the mirror towards the rider 4 upon attachment of the training device 13 to the board 5. Extending generally perpendicularly from the leg portion 19 are first foot 20 and second foot 21. The foot portions 20, 21 of the device are curved to fit within the upwardly curved tips of skis 35 or the like, thereby allowing the device to be placed as far forward on the ski as possible while maintaining maximum contact area between foot portions 20, 21 and the ski 35. Releasable attachment means 25 are affixed to the feet 20, 21 on the foot surface opposite the leg portion 19. As shown in FIG. 1, attachment means 25 are halves of interlocking fabric fasteners, such as is known by the trademark VELCRO. The cooperating halves of the fabric fasteners (not shown) are secured in a desired position on the ridden board 5, to releasably retain the training device 13 to the board 5.

Releasable attachment of the training device may be is desirable on two counts. One, the training device may be removed should a rider not desire the training feedback provided by his reflection in the device. Two, it is desirable from a safety standpoint to have the training device release from the board should the rider impact the device during a spill from the board.

In another embodiment, as shown in FIGS. 6–8, the casing is made as a unit 12 having an inclinded base portion 40 for holding the mirror 1, and a flat bottom, or mounting, surface 26. The embodiment of FIG. 12 shows a substantially identical device as FIG. 8 but having a curved mounting surface 36 corresponding to the curved tip of a ski 35 for maximum forward placement as explained above. The mounting surface 26 carries attachment means 25, such as interlocking fabric halves. The inclined base 29 has an increasing height from a first, or short, section 27 upward to a second, or tall, section 28. Thereby, when the mounting surface 26 is affixed to the board 5 with the short section 27 towards the rider 4, the mirror 1 will be inclined towards the rider 4. This unitary casing may simplify manufacturing, provide a broader base of support and a larger board contact area for larger mirror sizes, such as may be used on sailboards, and provide for the mounting of alternative attachment means. The unitary casing 12' may then be rounded to repel water or snow coming into contact with the device while riding the board.

Should adjustment of the mirror be required after the device 13 is mounted to the ridden board 5, internal adjustments to the mirror 1 axes may be made through adjustment knobs 37, set screws, or the like. The adjustment knobs 37 are accessible from the exterior of the casing 12' and are connected to mirror linkages (not shown) within the casing 12' such as may be known in the arts. It will, of course, be realized that the mirror to be useful as a training device, must be held securely in substantially the same inclination from the board at all times during the riding activity.

Alternative attachment means may include resilient sleeves attached to the board 5 which grasp the feet 20, 21 but would flex to release the training device 13 under pressure. When utilizing a unitary case 12', as in FIG. 5 a levered suction pad 30 such as commonly found on portable pencil sharpeners could be used for attachement, thus eliminating any cooperative attachment means fastened to the board. Magnetic attachment means are also contemplated. In water-sport applications such as sail boarding or water-skiing the casing 12 is preferably constructed to make the training device 13 buoyant. The casing is preferably painted in bright or florescent colors making the training device easily located if it is separated from the board.

Referring now to FIGS. 10 and 11, there is depicted therein a third embodiment. According to this embodiment, permanent or semipermanent affixation of the training device 13 to the ridden board 5 may also be desired for selected manufacturing and/or end use applications. In this embodiment it is contemplated that the unitary casing 12' would be used, or that the mirror 1 be fitted into the surface. The unitary casing has all edges rounded for safety reasons. Mechanical attachment means or adhesives, or both, are then used to fix the training device 13 to the board 5 with the desired degree of permanence.

As shown in FIG. 11, the surface of the board 5 could alternatively be designed and constructed so as to directly receive the convex mirror 1, to present a more finished appearance and avoid the need for additional mechanical or adhesive attachment.

In all embodiments the training device 13 is located at the forward end of the board(s) 5 to be ridden.

The present invention has particularly utility in skiing. On ridden boards, such as skis, that have raised tips, the training device would be located approximately where the board begins its rise thereby aiding in the proper inclination of the training device 13 towards the rider 4, and providing maximum forward location of the device on the board 5.

In use the training device is placed on the ridden board to reflect a body image of the rider with the reference lines being located along their appropriate axes. The rider then has merely to glance at the forward end of his board to receive appropriate feedback on his riding posture.

Having thus described the invention in connection with preferred embodiments what is claimed is:

1. A training device for a ridden board-type athletic device comprising:

(a) a convex mirror (b) means for attaching the training device to a ridden board-type athletic device;

(c) means for inclining the mirror off the horizontal when the training device is affixed to a ridden board-type athletic device;

(d) a casing containing the convex mirror and leaving the mirror reflective surface open to view;

(e) the casing surface opposite the mirror reflective surface being substantially planar and the inclination means being fixedly attached to the substantially planar surface; and (f) a leg assembly having at least two legs of unequal length and a curved surface corresponding to ridden board curved surface, the attachment means being affixed to the curved surface.

2. The training device according to claim 1 wherein the casing defines the inclination means.

3. The training device according to claim 1 wherein the attachment means is affixed to the inclination means.

4. The training device according to claim 1 wherein the attachment means are releasable.

5. The training device according to claim 1 further comprising: means for adjusting at least one axis of the mirror.

6. The training device according to claim 5 wherein the means for attaching is selected from the group consisting of:

interlocking fabric fasteners, magnetic attraction, adhesives, resilient sleeves, and suction devices.

7. A training device for a ridden board-type athletic device comprising;

(a) a convex mirror;

(b) means for attaching the training device to the ridden board-type athletic device;

(c) means for inclining the mirror off the horizontal when the training device is affixed to a ridden board-type athletic device;

(d) the attachment means being affixed to the inclination means; and, (e) the inclination means having a curved surface corresponding to a curve of the athletic device, and the attachment means is affixed to the curved surface.

8. A training device for a rider of board-type athletic devices, comprising in combination:

(a) a board-type athletic device capable of carrying a rider;

(b) a mirror assembly attached to the board-type athletic device, the mirror assembly having:

(1) a convex mirror (2) means for attaching the training device to the board-type athletic device to enable a rider of the athletic device to see his reflection during riding activities; and (3) means for inclining the mirror off the horizontal when the mirror device is attached to the board-type athletic device, the inclination means being capable of holding the mirror at a selected incline throughout the riding activity.

9. The training device according to claim 8 wherein: said inclination means is integrally formed from a surface of the board-type athletic device.

10. The training device according to claim 8 wherein the mirror device further includes a casing surrounding the convex mirror on all but its reflective surface.

11. The training device according to claim 10 further comprising: means for adjusting at least one axis of the mirror within the casing.

12. The training device according to claim 8 wherein the inclination means further comprises at least two legs of unequal length.

13. The training device according to claim 8 wherein the inclination means further comprises a unitary casing.

14. The training device according to claim 8 wherein the training device is permanently affixed to the board-type athletic device.

15. The training device according to claim 8 wherein the training device is detachably affixed to the board-type athletic device.

16. A training device for a rider of board-type athletic devices, comprising in combination:

(a) a board-type athletic device capable of carrying a rider;

(b) a mirror assembly attached to the board-type athletic device, the mirror assembly having:

(1) a convex mirror, (2) means for attaching the training device to the board-type athletic device, and (3) means for inclining the mirror off the horizontal when the mirrored device is attached to the board-type athletic device;

(c) wherein the board-type athletic device is a snow ski.

17. A training device for a rider of board-type athletic devices, comprising in combination:

(a) a board-type athletic device capable of carrying a rider;

(b) a mirror assembly attached to the board-type athletic device, the mirror assembly having:

(1) a convex mirror, (2) means for attaching the training device to the board-type athletic device, and (3) means for inclining the mirror off the horizontal when the mirror device is attached to the board-type athletic device; and, (c) reference lines on the convex mirror for helping the rider ascertain a correct driving posture.

18. The training device according to claim 17 wherein: said reference lines comprise a horizontal axis and vertical axis, (a) the horizontal axis being approximately parallel to the transverse axis of the board-type athletic device, the horizontal axis dividing the mirrored surface into a first, upper torso reflection portion and a second, lower torso reflecting portion;

(b) the vertical axis being approximately parallel to the longitudinal axis of the board-type athletic device, and bisecting the reflective surface of the mirror.

19. A training device for a rider of board-type athletic devices, comprising in combination:

(a) a board-type athletic device capable of carrying a rider;

(b) a mirror assembly attached to the board-type athletic device, the mirror assembly having:

(1) a convex mirror (2) means for attaching the training device to the board-type athletic device, and (3) means for inclining the mirror off the horizontal when the mirror device is attached to the board-type athletic device;

(c) the inclination means further comprising a unitary casing; and (d) the unitary casing further comprising: a bottom surface having a curve corresponding to a curve of the athletic device.

20. A method of training a rider of a ridden board-type athletic device comprising the steps of:

attaching a convex mirror to the athletic device in a position to allow the rider to see his reflection in the mirror while engaged in riding the athletic device.

21. The method of claim 20, further comprising the step of:

placing reference lines on the mirror to help the rider determine the proper posture for the desired riding activity.

* * * * *

UNITED STATES PATENT AND TRADEMARK OFFICE

CERTIFICATE OF CORRECTION

PATENT NO. : 5,037,303

DATED : 8/6/91

INVENTOR(S) : Jack L. Irwin

It is certified that error appears in the above-identified patent and that said Letters Patent is hereby corrected as shown below:

Column 1, line 33, delete "mirror" and insert --mirrors--.
Column 2, after line 45, insert --Fig. 12 illustrates the second embodiment with a curved mounting surface--.
Column 2, line 60, delete "made" and insert --may--.
Column 3, line 41, delete "as".
Column 3, line 61, delete "1" and insert --2--.
Column 3, line 67, delete "may be".
Column 5, Claim 6, line 1, delete "5" and insert --1--.

Signed and Sealed this

Twenty-third Day of March, 1993

*Attest:*

STEPHEN G. KUNIN

*Attesting Officer*

*Acting Commissioner of Patents and Trademarks*